US007467774B2

(12) United States Patent
Bohm et al.

(10) Patent No.: US 7,467,774 B2
(45) Date of Patent: Dec. 23, 2008

(54) ADJUSTABLE-HEIGHT CHAIR COLUMN

(75) Inventors: Walter Bohm, Feucht (DE); Helmut Kastner, Neukirchen (DE); Holger Knaust, Kummersbruck (DE); Gerhard Wunderling, Pegnitz (DE)

(73) Assignee: Stable II S.a.r.l, Luxembourg (LU)

( * ) Notice: Subject to any disclaimer, the term of this patent is extended or adjusted under 35 U.S.C. 154(b) by 325 days.

(21) Appl. No.: 11/038,270

(22) Filed: Jan. 21, 2005

(65) Prior Publication Data

US 2005/0161576 A1 Jul. 28, 2005

(30) Foreign Application Priority Data

Jan. 24, 2004 (DE) ..... 10 2004 003 623
Apr. 12, 2004 (DE) ..... 10 2004 023 335

(51) Int. Cl.
*F16M 13/00* (2006.01)

(52) U.S. Cl. ..... 248/631; 248/157

(58) Field of Classification Search ..... 248/161, 248/157, 631; 267/64.22, 64.28, 131; 297/344.18, 297/344.19, 344.16, 461
See application file for complete search history.

(56) References Cited

U.S. PATENT DOCUMENTS

| | | | | |
|---|---|---|---|---|
| 3,656,593 | A | 4/1972 | Bauer | |
| 4,245,826 | A * | 1/1981 | Wirges | 267/131 |
| 4,871,149 | A * | 10/1989 | Dony et al. | 267/64.12 |
| 5,620,067 | A * | 4/1997 | Bauer et al. | 188/322.19 |
| 5,806,828 | A | 9/1998 | Rothe et al. | |
| 6,276,756 | B1 * | 8/2001 | Cho et al. | 297/344.19 |
| 6,474,619 | B1 * | 11/2002 | Ma | 248/631 |
| 2006/0175743 | A1 * | 8/2006 | Chung | 267/64.12 |

FOREIGN PATENT DOCUMENTS

DE 44 28 259 C2 4/1997

* cited by examiner

*Primary Examiner*—Gwendolyn Baxter
(74) *Attorney, Agent, or Firm*—Browdy and Neimark, P.L.L.C.

(57) ABSTRACT

An adjustable-height chair column comprises an upright tube and a gas spring that is disposed coaxially in the upright tube. The gas spring comprises a valve for actuation of the gas spring. This valve is embodied for opening upon relief of the casing of the gas spring in relation to the upright tube.

7 Claims, 9 Drawing Sheets

ADJUSTABLE-HEIGHT CHAIR COLUMN

BACKGROUND OF THE INVENTION

1. Field of the Invention

The invention relates to an adjustable-height chair column, comprising an upright tube with a central longitudinal axis; a gas spring, which is disposed in the upright tube coaxially of the central longitudinal axis, and which comprises a casing that is filled with pressure fluid and displaceable in a direction of the central longitudinal axis into an extended position, a piston rod that is fixed in the upright tube, a piston that is mounted on the piston rod, dividing the casing into a first sectional casing chamber and a second sectional casing chamber the piston rod passes through, and a valve for interconnection of the first and second sectional chamber which comprises a valve gate with a valve throat that is coaxial of the central longitudinal axis, a valve pin that is disposed in the valve throat for displacement in a direction towards the first sectional casing chamber into a position of opening, having a blocking element, and a seal that, in a shut-off condition of the valve and upon load on the casing in relation to the upright tube, seals between the blocking element and the valve body.

2. Background Art

In an adjustable-height chair column of the generic type known from U.S. Pat. No. 5,806,828, the basic problem has been solved, which consists in restoring the seat in its elevated position upon relief of the chair column i.e., upon relief of the seat. A need of doing so may for instance occur in meeting-place furniture, in which case there may even be a need for the seats to be restored into a neutral position. The familiar chair column is provided with the conventional valve, by means of which standard height adjustment and control takes place with a user seated on the chair. The piston includes a blocking mechanism of automatic action which opens when the casing is relieved in relation to the upright tube. This known design is comparatively complicated.

SUMMARY OF THE INVENTION

It is an object of the invention to embody an adjustable-height chair column of the generic type in such a way that automatic extension of the casing from the upright tube upon relief of the casing is achieved by simple means.

According to the invention, this object is attained by the features wherein the valve is designed for opening upon relief of the casing in relation to the upright tube. The solution of the invention resides in that there is no need for a second blocking mechanism that opens automatically upon relief of the casing in relation to the upright tube, but that the valve itself is designed in such a way that it opens in case of such relief. The advantageous embodiment, according to which the blocking element has a greater diameter than an adjoining valve-pin sector which is in permanent connection with the second sectional casing chamber, helps attain that different forces act on the valve pin on both sides of the blocking elements, these forces keeping the valve shut off or opening it, depending on the load on, or relief of, the casing.

In keeping with a first advantageous embodiment of the valve, opening the valve can be accomplished especially easily by the seal which must necessarily exist between the valve body and sealing element being specifically designed as a lip seal which, upon load on the casing in relation to the upright tube, is pressed sealingly against the blocking element and which, upon relief of the casing, is lifted off the blocking element, interconnecting the sectional casing chambers. This embodiment enables an additional throttling gap to be provided especially easily, which acts only when the casing, upon corresponding relief, is automatically extended out of the upright tube so that this motion of extension takes place slowly, whereas standard height adjustment under load by manual operation of the valve takes place more rapidly.

In a second embodiment of the invention, the valve pin is loaded by a spring which is dimensioned in such a way that, with the casing relieved, it pushes the valve pin into the position of valve opening, whereas the force of the spring is not sufficient when the casing is loaded.

In a third embodiment of the invention, a channel is provided in the blocking element of the valve pin, with a displaceable seal being allocated thereto which, depending on the condition of load on the gas spring, is displaced in such a way that the connection between the sectional casing chambers is produced or blocked.

Further features, advantages and details of the invention will become apparent from the ensuing description of two exemplary embodiments, taken in conjunction with the drawing.

DESCRIPTION OF PREFERRED EMBODIMENTS

Figure 1:
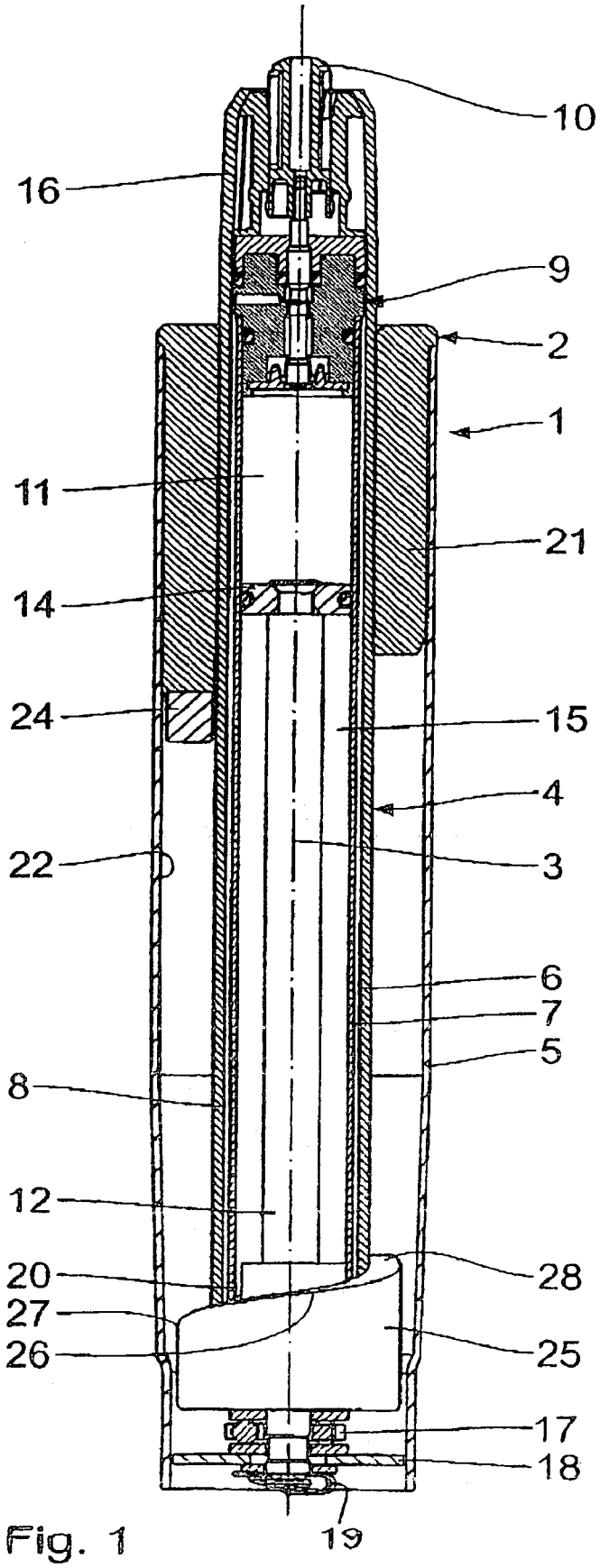
FIG. 1 is a longitudinal sectional view of a retracted chair column formed by an adjustable-length gas spring and an upright tube.
Figure 2:
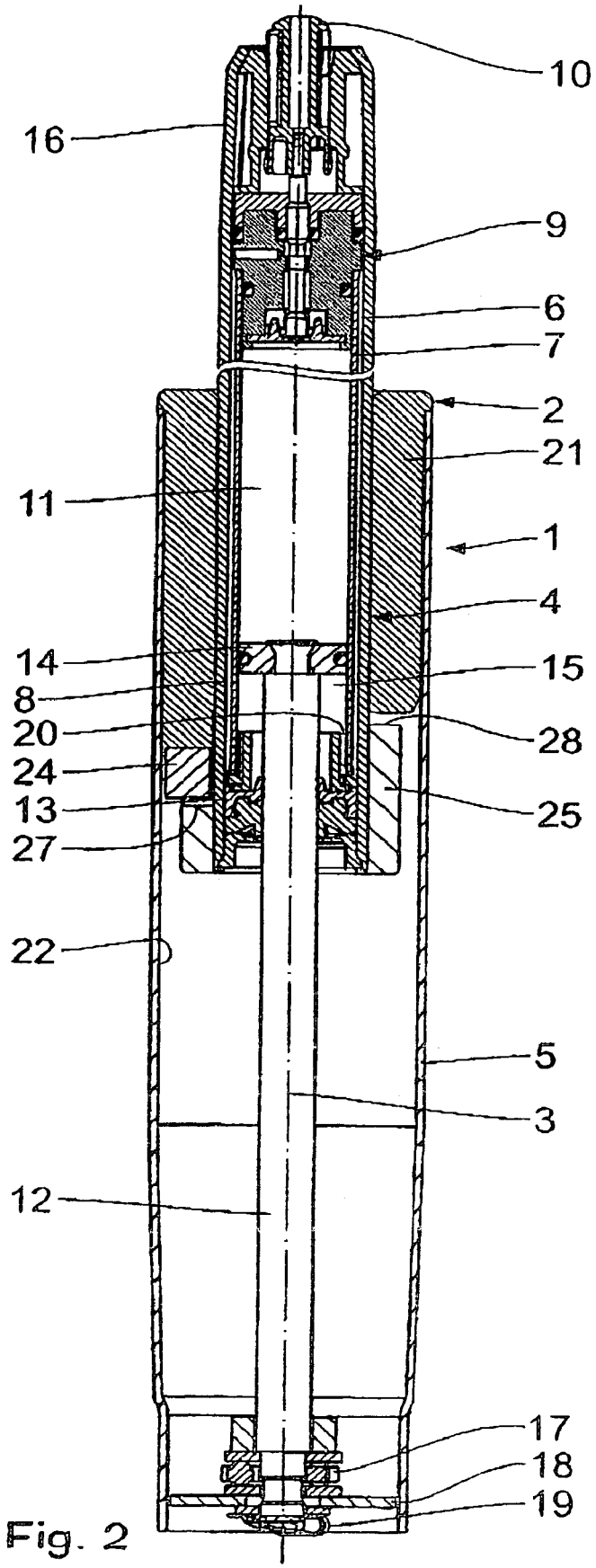
FIG. 2 is a view of the chair column of FIG. 1 when extended.

The chair column seen in the drawing, in particular in FIGS. 1 and 2, comprises an upright tube 1 and an adjustable-length gas spring 4 which is guided therein by means of a guide bush 2 for displacement in the direction of a common central longitudinal axis 3. The bottom end of the upright tube 1 is provided with a holding cone 5 for attachment to a conventional chair pedestal.

The gas spring 4 has a substantially cylindrical housing 6 which is guided in the guide bush 2. An internal tube 7 is disposed in the housing 6 concentrically of the axis 3, with a ring channel 8 being provided between the internal tube 7 and the housing 6. A valve 9 is disposed in the housing 6 at the top end thereof that is outside the upright tube 1; the valve 9 is operable by means of an operating pin 10 that projects from the housing 6. It serves for optionally connecting the ring channel 8 to the first sectional housing chamber 11 that is formed inside the internal tube 7 in vicinity to the valve 9.

A piston rod 12 is disposed in the internal tube 7 concentrically of the axis 3 and for displacement in the direction thereof; it is extended out of the bottom end of the housing 6 that is opposite the valve 9 inside the upright tube 1. A guide and seal unit 13 serves for gas-tight guidance of the piston rod 12 in this area. A piston 14 is mounted on the end, inside the internal tube 7, of the piston rod 12; it is guided on, and sealed towards the internal tube 7, dividing the first sectional housing chamber 11 from a second sectional housing chamber 15 that is formed between the piston 14 and the guide and seal unit 13. A fastening section 16 that tapers conically is formed on the housing 6 at the end thereof in vicinity to the valve 9; by means of the fastening section 16 the gas spring 4 is mountable on a corresponding receptacle on the bottom side of a seat, for example a seat support. At its bottom end, outside the housing 6, the piston rod 12 is supported by way of an axial bearing 17 on the bottom 18 of the upright tube 1 where it is releasably secured by a fixing clamp 19.

The ring channel 8 and the sectional housing chambers 11 and 15 are filled with gas under comparatively high pressure and possibly with a given quantity of oil. In the vicinity of the guide and seal unit 13, the second sectional housing chamber 15 is permanently connected to the ring channel 8 by means of an overflow channel 20. The entire structure and mode of operation of the gas spring 4—as far as specified hereinbefore—are generally known for example from the basic patent U.S. Pat. No. 3,656,593. Correspondingly, the fundamental design and mode of operation of the chair column are known from DE 19 31 021.

Figure 3:
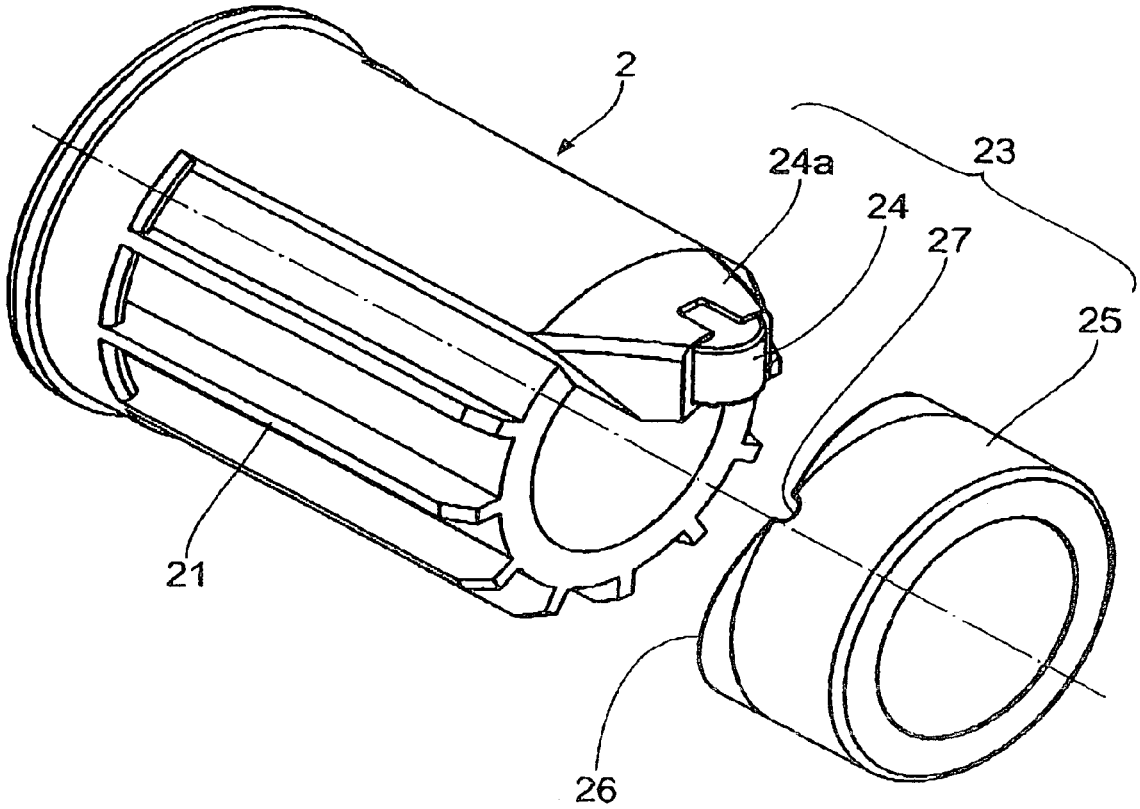
FIG. 3 is a perspective exploded view of a mechanism of reverse rotation of the chair column.

As seen in particular in FIG. 3, but just as well in FIGS. 1 and 2, the guide bush 2 is provided outside with longitudinal ribs 21, by means of which it supports itself on the inside wall 22 of the upright tube 1 radially of the axis 3. The chair column is provided with a mechanism of reverse rotation 23 by means of which the casing 6 of the gas spring 4, when extended according to FIG. 2, can be moved into a given position of rotation in relation to the upright tube 1. This mechanism 23 comprises a roll 24 as a guide element which is located on the end, inside the upright tube 1, of the guide bush 2, and an annular rotation-guide member 25 which is tightly joined to the casing 6 of the gas spring 4, having a guide surface 26. The roll 24 flexibly snap-engages with a receptacle 24*a* that is provided at the bottom end of the guide bush 2, where it is mounted freely rotatably. The receptacle 24*a* and the roll 24 cooperate to form another rotation-guide member.

The guide surface 26 includes a central-position area formed by a recess 27 which the roll 24 bears against in a position of the casing 6 of utmost extension from the upright tube 1. From this central-position area 27, the guide surface 26 ascends as far as to an external-position area 28 that diametrically opposes the area 27. From the area 27, the guide surface 26 ascends clockwise as well as counter-clockwise. When, with the valve 9 open, the casing 6 is extended from the upright tube 1, the guide surface 26 will bear against the roll 24 in any position. With the ascent of the guide surface 26 in relation to the axis 3 and the force of extension that works between the guide surface 26 and the roll 24 also producing a tangential component of this force, the casing 6, in the final stage of the motion of extension, is rotated in such a way that the central-position area 27 moves under the roll 24, The designation "central-position area 27" originates from the fact that a seat of a chair is being fixed on the fastening section 16 of the gas spring 4 in such a way that, with the roll 24 in touch with the area 27, it finds itself in an oriented central position. Consequently, upon complete extension of the casing 6 from the upright tube 1, the seat will always move into its oriented central position. This has been generally known for example from U.S. Pat. No. 5,806,828. The recess 27 is provided on the guide surface 26 in the central-position area for the fixing action in this central position still to be improved. As it were, the roll 24 snap-engages with the recess 27.

Figure 4:
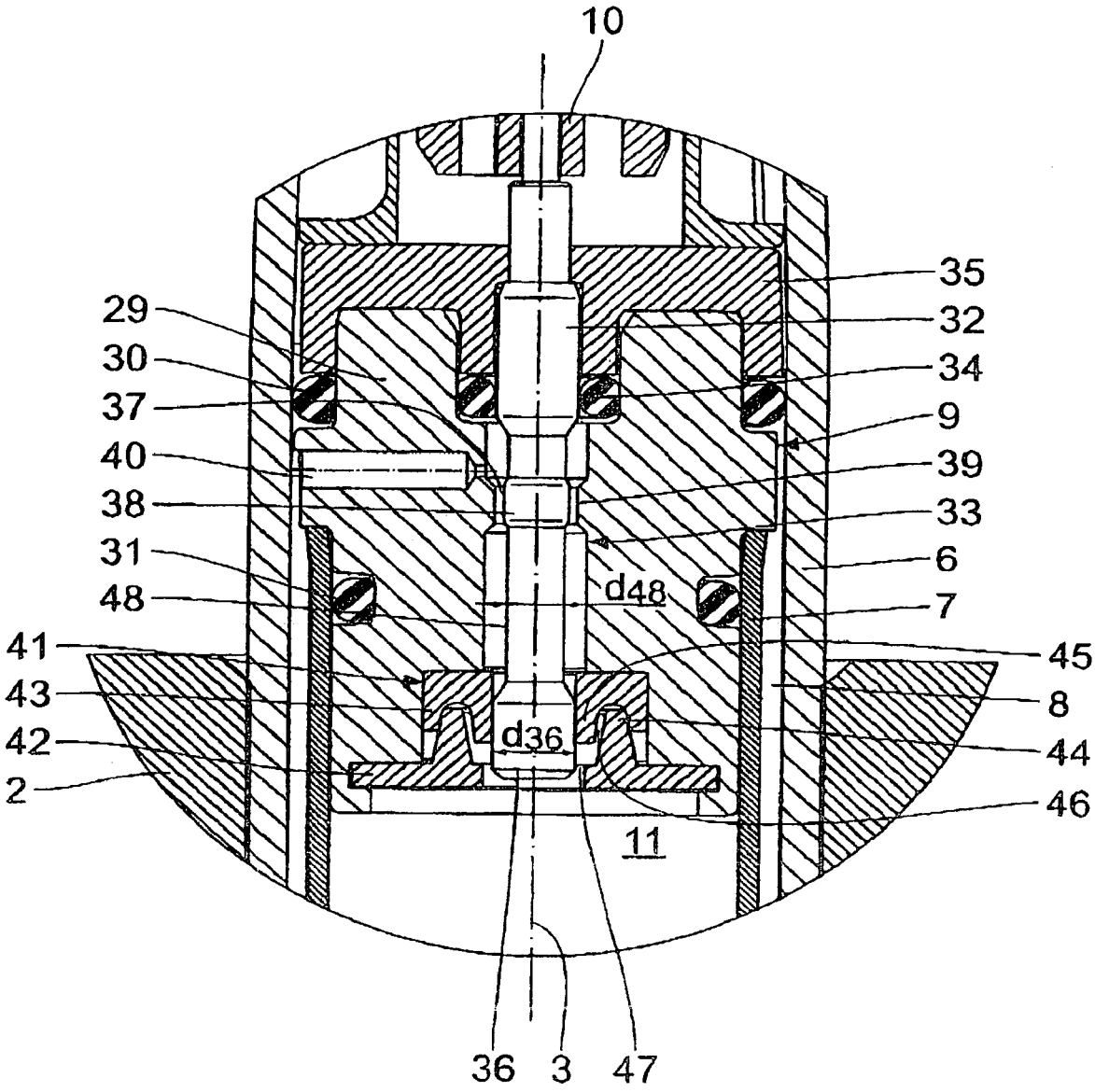
FIG. 4 is a longitudinal sectional view of a first embodiment of a valve of the gas spring when shut off.
Figure 5:
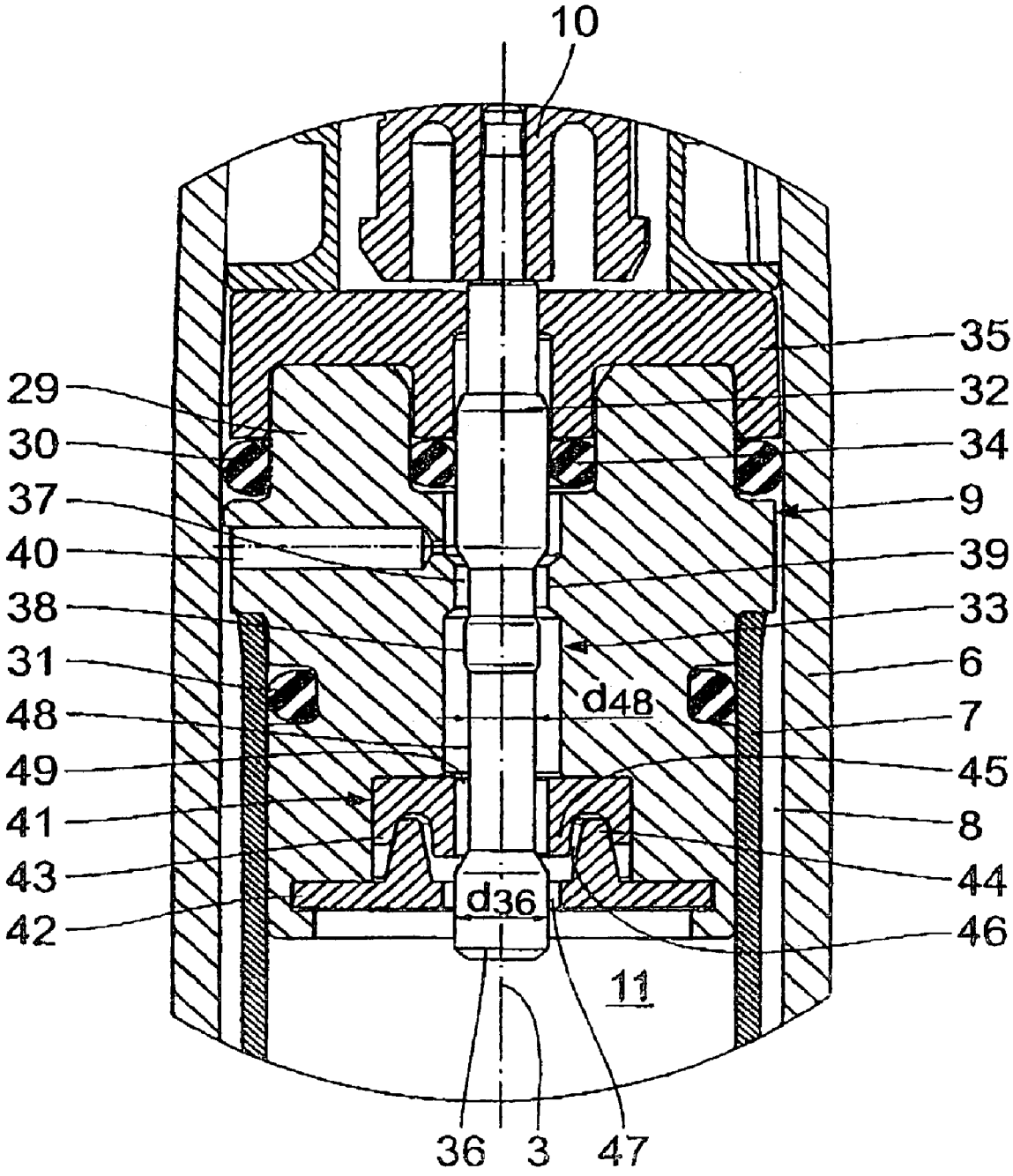
FIG. 5 is a view of the valve of FIG. 4 when opened manually.
Figure 6:
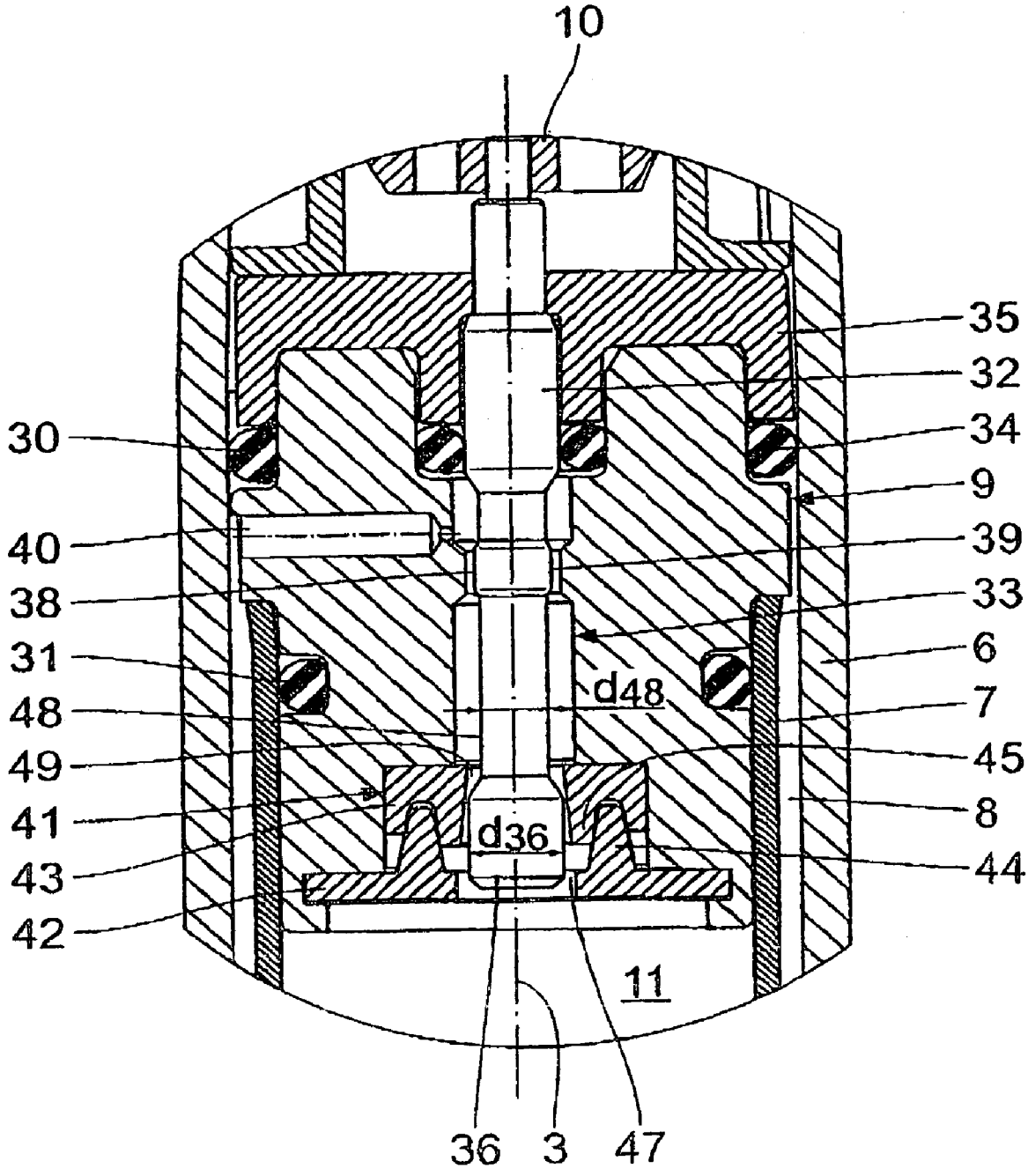
FIG. 6 is a view of the valve of FIGS. 4 and 5 when opened automatically.

An embodiment of the valve 9 is seen in FIGS. 4 to 6. It comprises a valve body 29 which, at its end turned towards the operating pin 10, gas-tightly seals the entire interior of the casing 6 towards the outside by means of a seal 30. Turned towards the first sectional casing chamber 11, another seal 31 is provided, gas-tightly sealing the first sectional casing chamber 11 towards the ring channel 8. Coaxially of the central longitudinal axis 3, a valve pin 32 is disposed in the valve body 29 for displacement in the direction of the axis 3 in a continuous valve throat 33. In the external area that neighbours the operating pin 10, the valve throat 33 is gas-tightly sealed externally by a seal 34 which rests on the valve body 29 on the one hand and on the valve pin 32 on the other. The seals 30 and 34 are kept positioned by means of an outer bonnet 35 that is fixed to the valve body 29. This bonnet 35 simultaneously serves as a safeguard against extension of the valve pin 32.

At its end tamed towards the first sectional casing chamber 11, the valve pin 32 possesses a valve block 36 as a blocking element. Formed between the external seal 34 and the valve block 36 is a throttle gap 37 which is defined by a throttle bead 38 of the valve pin 32 and a contraction 39 of the valve throat 33. Between the throttle gap 37 and the external seal 34, a connecting passage 40 mouthes into the valve throat 33, joining the ring channel 8 to the valve throat 33. It is dimensioned for only slight throttling action on any pressure fluid that passes through.

In the proximity of the first sectional casing chamber 11, a seal 41 is disposed in the valve body 29; the seal 41 is axially retained on the valve body 29 by means of a supporting ring 42 that is turned towards the first sectional casing chamber 11. This seal 41 is a double-lip seal, the external, annular sealing lip 43 of which bears permanently tightly against the valve body 29, in which action it is assisted by an annular supporting rib 44 of the supporting ring 42. The seal 41 further includes an internal, annular sealing lip 45 which also faces towards the first sectional casing chamber 11. In the position, according to FIG. 4, of the valve 9, in which the internal sealing lip 45 bears sealingly against the valve block 36, an annular clearance zone 46 forms between the supporting rib 44 and the internal sealing lip 45. A great annular overflow gap 47 is provided between the cylindrical valve block 36 and the supporting ring 42. The diameter $d_{36}$ of the valve block 36 exceeds the diameter $d_{48}$ of the valve-pin sector 48 between the valve block 36 and the throttle bead 38.

In any adjusted position of height and length of the chair column, the casing 6 of the gas spring 4 may for example be in a position according to FIG. 1. The valve 9 is shut off. The valve pin 32 is positioned according to FIG. 4. With the gas pressure inside the first sectional casing chamber 11 being greater than it is in the second sectional casing chamber 15, owing to load from above on the casing 6 exercised for instance by a person seated on the chair, the internal sealing lip 45 is tightly pressed against the valve block 36; the valve 9 is shut off tightly. Any adjustment in length of the gas spring 4 does not take place.

When, by the operating pin 10 being pressed, the valve pin 32 is displaced in a direction towards the first sectional casing chamber 11, as seen in FIG. 5, then the valve block 36 lifts off the internal sealing lip 45 of the seal 41. Moreover, the throttle bead 38 is pushed out of the contraction 39 so that the throttle gap 37 is cancelled. As seen in FIG. 5, free flow of gas is possible from the ring channel 8 towards the first sectional casing chamber 1 and vice versa, with only slight throttling action taking place in the connecting passage 40—as upon every opening of the valve 9. In this way, eight adjustment of the chair column takes lace. By release of the operating pin 10, the valve pin 32 is pushed outwards by the gas pressure inside the first sectional casing chamber 11, and the valve 9 is shut off again.

If, however, with the valve 9 shut off i.e., with the valve pin 32 positioned according to FIG. 4, the chair column is relieved, which means if there is no load exercised from above on the casing 6 upon use, then the pressure drops in the first sectional casing chamber 11 so that a pressure difference is produced between the first sectional casing chamber 11 and the second sectional casing chamber 15; by way of the ring channel 8 and the connecting passage 40, this pressure difference also acts on the valve pin 32. Consequently, the higher pressure inside the second sectional casing chamber 15, proceeding from the throttle gap 37, acts on the internal sealing lip 45 of the seal 41, lifting it off the valve block 36—as seen in FIG. 6—without the valve pin 32 being displaced in the direction of the axis 3. Pressure compensation takes place by gas flowing into the first sectional casing chamber 11 from the second sectional casing chamber 15 via the ring channel 8, the connecting passage 40, the throttle gap 37 and the compensation channel 49 that is formed between the valve block 36 and the internal sealing lip 45. Since, with equal pressure prevailing in both sectional casing chambers 11, 15, the free cross-sectional area of the first sectional casing chamber 11 exceeds that of the second sectional casing chamber 15, the piston rod 12 is pushed out of the casing 6 i.e., the casing 6 is extended upwards out of the upright tube 1. Upon relief of a seat which is for example mounted on the casing 6, the casing 6, and thus the seat, is moved automatically into its upper position and moreover rotated into its central position as already described above.

Figure 7:
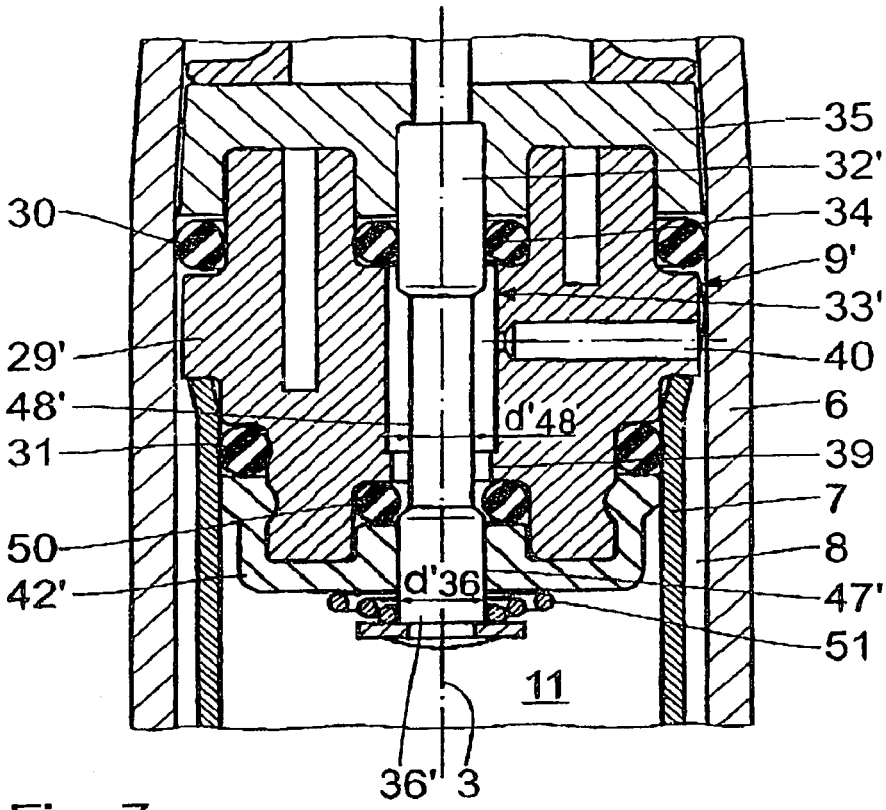
FIG. 7 is a longitudinal sectional view of a second embodiment of a valve when shut off.
Figure 8:
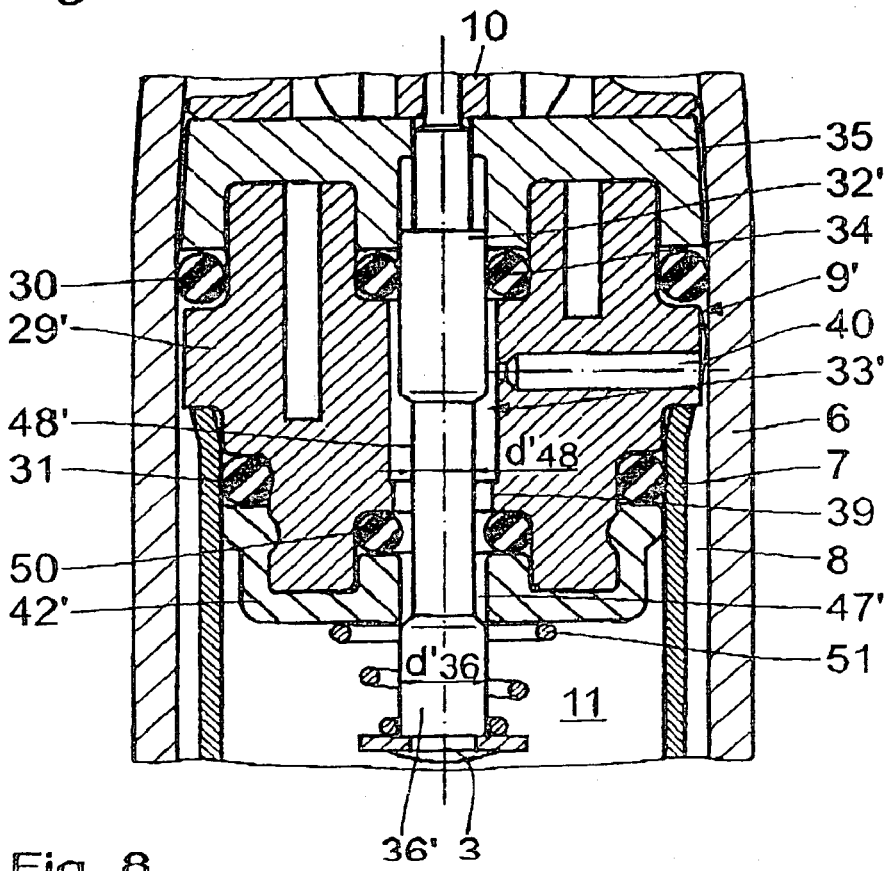
FIG. 8 is an illustration of the valve of FIG. 7 when opened manually.
Figure 9:
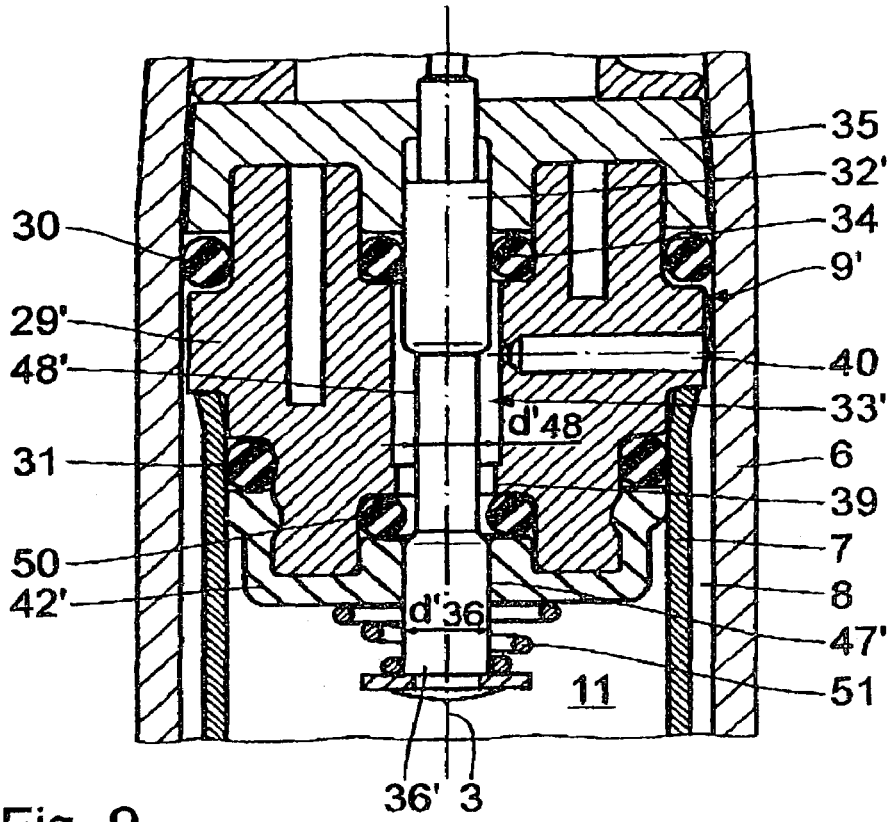
FIG. 9 is a view of the valve of FIGS. 7 and 8 when opened automatically.

In as much as there are any components in the second embodiment of a valve 9' according to the invention as seen in FIGS. 7 to 9 that are the same as in the embodiment according to FIGS. 4 to 6, identical reference numerals are used. In as much as components exist that are functionally identical, but slightly deviate constructionally, the same reference numeral is used, however provided with a prime. There is no need of renewed explicit description.

A seal 50 in the form of an annular seal is disposed between the valve block 36' and the valve body 29'; it kept positioned b) means of a supporting ring 42'. When the valve 9' is shut off i.e., with the valve pin 32' not displaced, it will always bear against the valve block 36'. Outside the valve body 29', the valve pin 32' is loaded by a pre-stressed compression spring 51 in the form of a conical spring in a direction towards the first sectional casing chamber 11. The compression spring 51 works in the direction of opening of the valve pin 32'. With the valve 9' shut off and the casing 6 loaded from above by a seat of a chair, the pressure in the first sectional casing chamber 11 exceeds that in the second sectional casing chamber 15. Moreover the diameter $d'_{36}$ of the valve block 36' exceeds the diameter $d'_{48}$ of the valve pin sector 48'. The compression spring 51 is dimensioned and pre-loaded for exercising a force of opening on the valve pin 32' that is inferior to the resulting load of gas pressure exercised by the described differences in pressure and cross section.

When, in accordance with FIG. 8, the valve 9' opens by the operating pin 10 being pressed and thus by insertion of the valve pin 32' in the direction towards the first sectional casing chamber 11, then the valve block 36' lifts off the seal 50—as seen in FIG. 8—so that gas may flow: from the first sectional casing chamber 11 through an overflow gap 47' between the supporting ring 42' and the valve block 36; through the valve throat 33' in the vicinity of the tapered valve pin sector 48'; through the connecting passage 40, the ring channel 8 and the overflow channel 20; and to the second sectional casing chamber 15 and vice versa. In this way, conventional height adjustment of the chair column is put into practice when the user sits on the seat that is supported by the casing 6.

If, however, the casing 6 is completely relieved in accordance with the illustration of FIG. 9, then—as described above—the pressure drops in the first sectional casing chamber 11. The compression spring 51 can push the valve pin 32' in the direction towards the first sectional casing chamber 11, which is the direction of opening, as a result of which the valve block 36' lifts off the seal 50, thereby enabling pressure compensation to take place in the way described. The compression spring 51 is dimensioned and pre-loaded for exercising a force of opening on the valve pin 32' that exceeds the shut-off force still acting on it.

Figure 10:
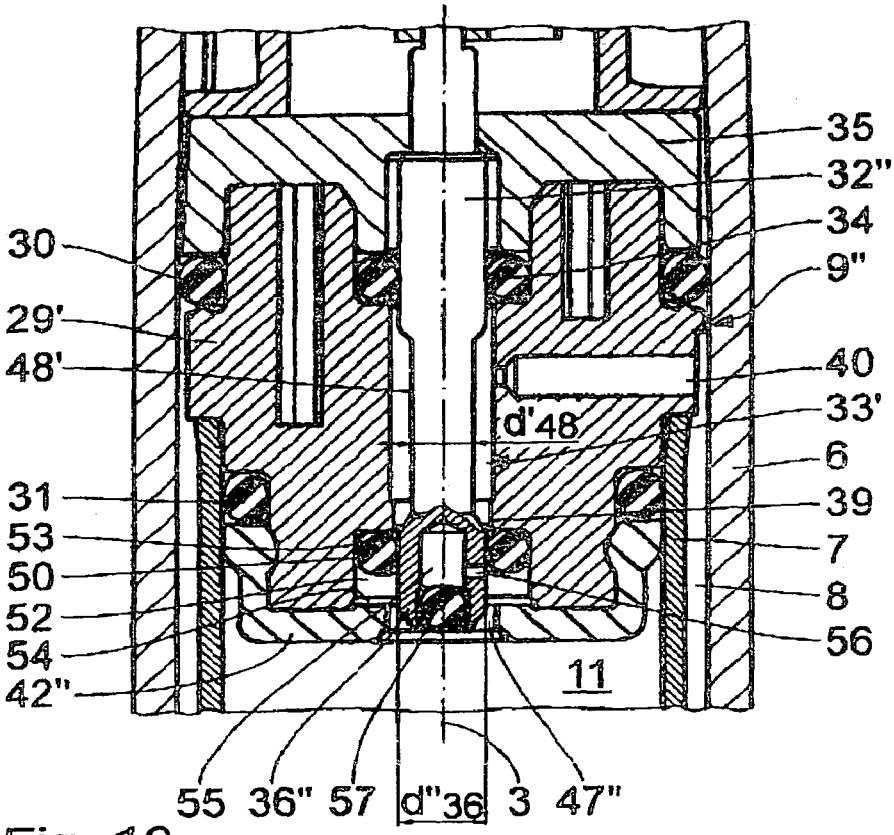
FIG. 10 is a longitudinal section view of a third embodiment of a valve when shut off.
Figure 11:
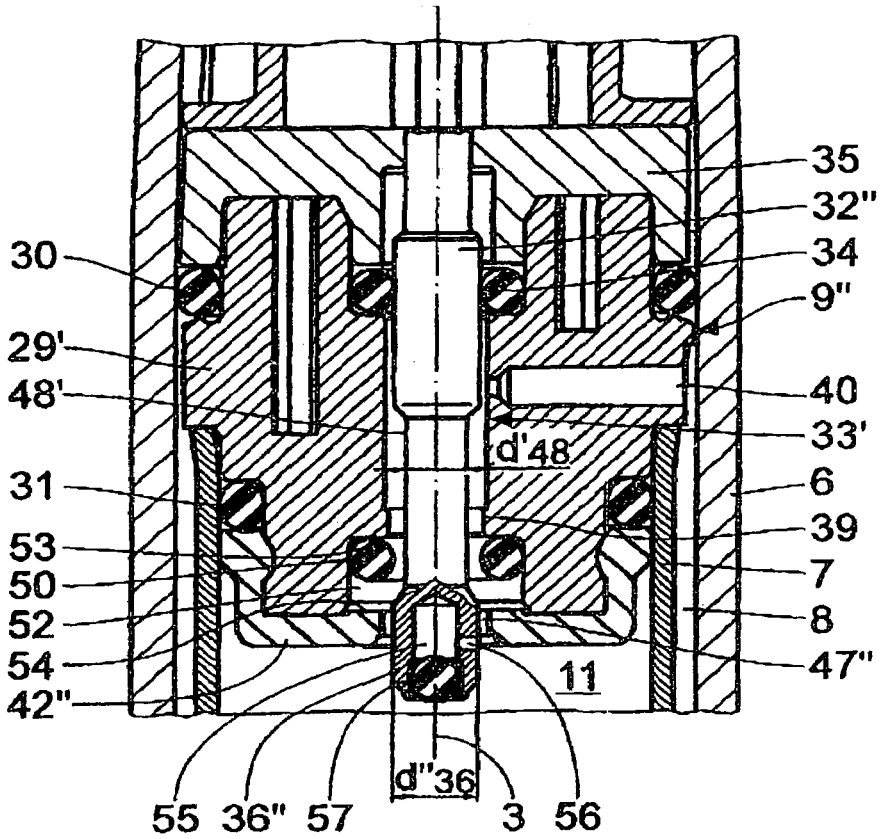
FIG. 11 is a view of the valve of FIG. 10 when opened manually.
Figure 12:
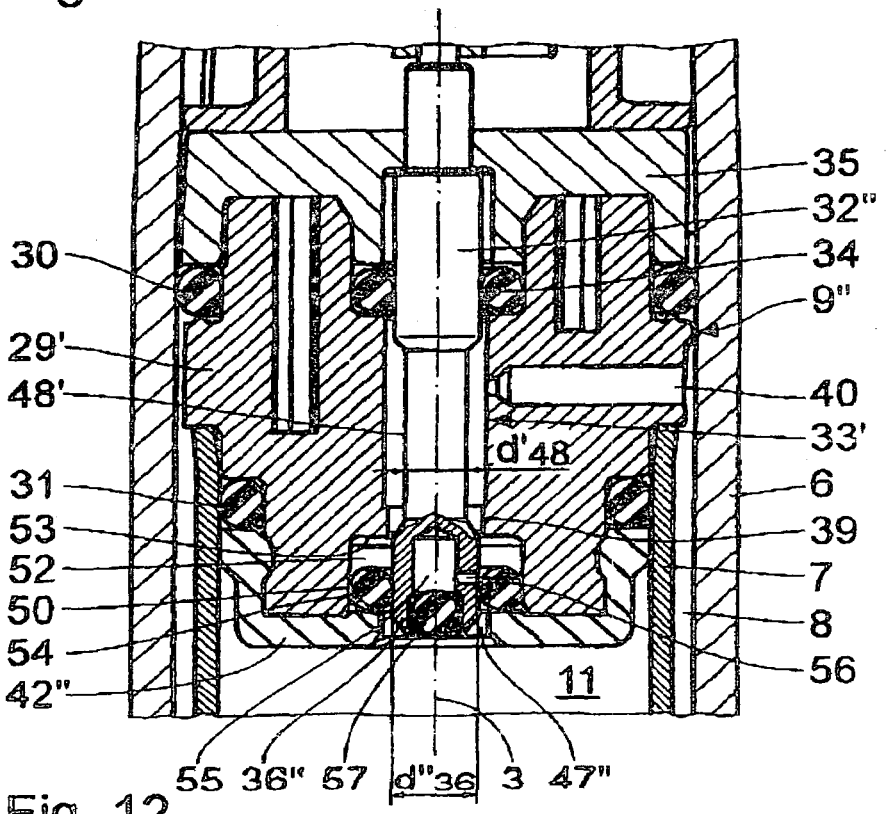
FIG. 12 is a view of the valve of FIGS. 10 and 11 when opened automatically.

In as much as there are any components in the third embodiment of a valve 9" according to the invention as seen in FIGS. 10 to 12 that are the same as in the embodiments according to FIGS. 4 to 6 and 7 to 9, identical reference numerals are used. In as much as components exist that are functionally identical, but slightly deviate constructionally, the same reference numeral is used, however provided with a double prime. There is no need of renewed explicit description.

The supporting ring 42" does not possess any annular collar that projects into the valve body 29' so that an approximately annular cylindrical space 52 is defined in the valve body 29' in vicinity to the valve block 36", with a seal 50 being disposed therein. In this space 52, the seal 50 can be moved in the direction of the central longitudinal axis 3 between two stops, namely a first stop 53 and a second stop 54 that are formed by the valve body 29' on the one hand and by the supporting ring 42" on the other. An overflow channel 55 is formed in the valve block 36"; it runs coaxially of the axis 3, with a throttle channel 56 mouthing therein radially of the axis 3. A ball-shaped throttle element 57 can be disposed additionally in the overflow channel 55. In this case, the channel 56 may be embodied s a throttle channel, which is however not forcibly necessary. The throttle channel 56 is disposed in such a way that it mouthes into the space 52 when the valve pin 32" is in the shut-off position according to the illustration of FIGS. 10 and 12.

In the shut-off position of the valve 9" seen in FIG. 10, the seal 50 is in a position bearing against the internal first stop 53 that is provided inside the valve body 29'. In doing so, there is sealing action by the seal 50 between the valve block 36" and the valve body 29' i.e., the connection between the ring channel 8 and the sectional casing chamber 11 is blocked by means of the valve 9". The gas spring 4 is blocked.

Upon insertion of the valve pin 32" towards the sectional casing chamber 11, the valve block 36" is lifted off the seal 50, as seen in FIG. 11. The connection between the ring channel 8 and the sectional casing chamber 11 is being opened. The gas spring 4 can be adjusted in length in the way described. Until lift-off of the valve block 36" from the seal, the seal is kept positioned on the internal first stop 53, owing to the gas pressure that acts from the sectional casing chamber 11, since, prior to the valve block 36" lifting off the seal 50, the gas pressure works via the overflow gap 47" into the space 52 and presses full-face against the seal 50; and since the gas pressure from the second sectional casing chamber 15 that acts on the seal 50 via the ring channel 8 is inferior to the gas pressure that acts from the first sectional casing chamber 11.

If, however—in accordance with the illustration of FIG. 12 and comparable to the illustrations of FIGS. 6 and 9 and in accordance with the respective description thereof—the casing 6 of the gas spring 4 is relieved, then, corning from the bottom sectional casing chamber 15 via the ring channel 8 and the connection passage 40, higher gas pressure acts on the seal 50 than from the sectional casing chamber 11 so that the seal is displaced in a direction towards the external second stop 54 on the supporting ring 42". In this position of the seal 50, the throttle channel 56, and thus the overflow channel 55, is joined to the valve throat 33', as a result of which gas is again able to flow from the sectional casing chamber 15 via the ring channel 8, the connecting passage 40, the valve throat 33', the space 52, the throttle channel 56 and the overflow channel 55, and into the first sectional casing chamber 1. The gas spring 4 is extended by throttled, and consequently damped, action.

What is claimed is:

1. An adjustable-height chair column, comprising an upright tube (1) with a central longitudinal axis (3);

a gas spring (4), which is disposed in the upright tube (1) coaxially of the central longitudinal axis (3), and which comprises a casing (6) that is filled with pressure fluid and displaceable in a direction of the central longitudinal axis (3) into an extended position, a piston rod (12) that is fixed in the upright tube (1), a piston (14) that is mounted on the piston rod (12), dividing the casing into a first sectional casing chamber (11) and a second sectional casing chamber (15) the piston rod (12) passes through, and a valve (9, 9', 9") for interconnection of the first and second sectional chamber (11, 15) which comprises a valve gate (29, 29') with a valve throat (33, 33') that is coaxial of the central longitudinal axis (3), a valve pin (32, 32', 32") that is disposed in the valve throat (33, 33') for displacement in a direction towards the first sectional casing chamber (11) into a position of opening, having a blocking element (36, 36', 36"), and a seal (41, 50) that, in a shut-off condition of the valve (9, 9', 9") and upon load on the casing (6) in relation to the upright tube (1), seals between the blocking element (36, 36', 36") and the valve body (29, 29');

wherein the valve (9, 9', 9") is designed for opening upon relief of the casing (6) in relation to the upright tube (1);

wherein a mechanism of reverse rotation (23) is provided between the upright tube (1) and the casing (6).

2. A chair column according to claim 1, wherein the blocking element (36, 36', 36") has a greater diameter ($d_{36}$, $d'_{36}$, $d''_{36}$) than an adjoining valve-pin sector (48, 48') which is in permanent connection with the second sectional casing chamber (15).

3. A chair column according to claim 1, wherein between the valve pin (32) and the valve body (29), provision is made for a throttle gap (37) which is opened in a direction towards the position of opening upon displacement of the valve pin (32).

4. A chair column according to claim 1, wherein the seal (50) between the blocking element (36') and valve body (29') is an annular seal, which is disposed in the valve body (29') in an annular cylindrical space (52) that envelops the blocking element (29'), for displacement between a first stop (53) and a second stop (54);

wherein a channel (55, 56) is provided in the blocking element (36"), permanently joining the first sectional casing chamber (11) to the space (52); and wherein, upon load on the casing (6) in relation to the upright tube (1), the seal (50) bears against the first stop (53), sealing the space (52) towards the valve throat (33') and, upon relief of the casing (6), bears against the second stop (54) without displacement of the valve pin (32"), opening the space (52) towards the valve throat (33').

5. A chair column according to claim 4, wherein the channel (55, 56) which permanently connects the first sectional casing chamber (11) with the space (52) is formed for throttling action.

6. An adjustable-height chair column, comprising an upright tube (1) with a central longitudinal axis (3);

a gas spring (4), which is disposed in the upright tube (1) coaxially of the central longitudinal axis (3), and which comprises a casing (6) that is filled with pressure fluid and displaceable in a direction of the central longitudinal axis (3) into an extended position, a piston rod (12) that is fixed in the upright tube (1), a piston (14) that is mounted on the piston rod (12), dividing the casing into a first sectional casing chamber (11) and a second sectional casing chamber (15) the piston rod (12) passes through, and a valve (9, 9', 9") for interconnection of the first and second sectional chamber (11, 15) which comprises a valve gate (29, 29') with a valve throat (33, 33') that is coaxial of the central longitudinal axis (3), a valve pin (32, 32', 32") that is disposed in the valve throat (33, 33') for displacement in a direction towards the first sectional casing chamber (11) into a position of opening, having a blocking element (36, 36', 36"), and a seal (41, 50) that, in a shut-off condition of the valve (9, 9', 9") and upon load on the casing (6) in relation to the upright tube (1), seals between the blocking element (36, 36', 36") and the valve body (29, 29');

wherein the valve (9, 9', 9") is designed for opening upon relief of the casing (6) in relation to the upright tube (1);

wherein the seal (50) between the blocking element (36') and valve body (29') is an annular seal, which is disposed in the valve body (29') in an annular cylindrical space (52) that envelops the blocking element (29'), for displacement between a first stop (53) and a second stop (54);

wherein a channel (55, 56) is provided in the blocking element (36"), permanently joining the first sectional casing chamber (11) to the space (52); and wherein, upon load on the casing (6) in relation to the upright tube (1). the seal (50) bears against the first stop (53), sealing the space (52) towards the valve throat (33') and, upon relief of the casing (6), bears against the second stop (54) without displacement of the valve pin (32"), opening the space (52) towards the valve throat (33').

7. A chair column according to claim 6, wherein the channel (55, 56) which permanently connects the first sectional casing chamber (11) with the space (52) is formed for throttling action.

* * * * *